US008066446B2

(12) United States Patent
Martinez et al.

(10) Patent No.: US 8,066,446 B2
(45) **Date of Patent: *Nov. 29, 2011**

(54) APPARATUS AND METHOD FOR DISABLING A GROUND ENGAGING TRACTION DEVICE OF A LAND VEHICLE

(75) Inventors: Martin A. Martinez, Phoenix, AZ (US); Patrick Barnhill, Phoenix, AZ (US); Brian Rosner, Phoenix, AZ (US)

(73) Assignee: Pacific Scientific Energetic Materials Company, Valencia, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/582,703

(22) Filed: Oct. 20, 2009

(65) Prior Publication Data

US 2010/0221066 A1 Sep. 2, 2010

Related U.S. Application Data

(63) Continuation-in-part of application No. 12/537,224, filed on Aug. 6, 2009.

(60) Provisional application No. 61/195,281, filed on Oct. 6, 2008.

(51) Int. Cl.
*E01F 13/12* (2006.01)

(52) U.S. Cl. ..... 404/6

(58) Field of Classification Search ..... 404/6; 89/7; *E01F 13/12*

See application file for complete search history.

(56) References Cited

U.S. PATENT DOCUMENTS

| | | | |
|---|---|---|---|
| 3,456,920 | A | 7/1969 | Elvington |
| 5,322,385 | A | 6/1994 | Reisman |
| 5,330,285 | A | 7/1994 | Greves et al. |
| 5,452,962 | A | 9/1995 | Greves |
| 5,507,588 | A | 4/1996 | Marts et al. |
| RE35,373 | E | 11/1996 | Kilgrow et al. |
| 5,775,832 | A | 7/1998 | Kilgrow et al. |
| 5,820,293 | A | 10/1998 | Groen et al. |
| 5,839,849 | A | 11/1998 | Pacholok et al. |
| 5,871,300 | A | 2/1999 | Ingham |
| 5,890,832 | A | 4/1999 | Soleau |
| 5,904,443 | A | 5/1999 | Soleau |
| 6,155,745 | A | 12/2000 | Groen et al. |

(Continued)

FOREIGN PATENT DOCUMENTS

CN 1263253 A 8/2000

(Continued)

OTHER PUBLICATIONS

International Search Report and Written Opinion, International Application No. PCT/US2009/058892, Filed on Sep. 29, 2009, Applicant: Pacific Scientific Energetic Materials Company, Mailed on Nov. 19, 2009, 10 pages.

(Continued)

*Primary Examiner* — Gary S Hartmann
(74) *Attorney, Agent, or Firm* — Perkins Coie LLP

(57) ABSTRACT

An apparatus and a method for disabling a ground engaging traction device of a land vehicle includes at least one penetrator configured to breach the traction device, an articulated strap configured to move a plurality of times between a retracted arrangement and an extended arrangement, an inflatable bladder configured to deploy the articulated strip to the extended arrangement, and a retractor configured to retract the articulated strip to the retracted arrangement. The articulated strip includes a plurality of plates coupled to the penetrators and a plurality of joints, wherein individual joint couples individual adjacent plates.

11 Claims, 15 Drawing Sheets

U.S. PATENT DOCUMENTS

| | | | |
|---|---|---|---|
| 6,206,608 | B1 | 3/2001 | Blevins |
| 6,220,781 | B1 | 4/2001 | Miller |
| 6,224,291 | B1 | 5/2001 | Mateychuk |
| 6,322,285 | B1 | 11/2001 | Ben |
| 6,409,420 | B1 | 6/2002 | Horton et al. |
| 6,474,903 | B1 | 11/2002 | Marts et al. |
| 6,527,475 | B1 | 3/2003 | Lowrie |
| 6,551,013 | B1 | 4/2003 | Blair |
| 6,623,205 | B1 | 9/2003 | Ramirez |
| 6,716,234 | B2 | 4/2004 | Grafton et al. |
| 6,758,628 | B1 | 7/2004 | Curry, Jr. |
| 6,997,638 | B2 | 2/2006 | Hensley et al. |
| 7,011,470 | B1 | 3/2006 | Breazeale et al. |
| 7,025,526 | B2 | 4/2006 | Blair |
| 7,201,531 | B2 | 4/2007 | Shackelford et al. |
| 7,220,076 | B2 | 5/2007 | Boll |
| 7,226,238 | B2 | 6/2007 | Collier |
| 7,441,982 | B1 | 10/2008 | Al-Sabah |
| 7,524,134 | B2 | 4/2009 | Rastegar et al. |
| 7,573,379 | B2 | 8/2009 | Moormeier et al. |
| 2005/0244223 | A1 | 11/2005 | Shackelford et al. |
| 2006/0140715 | A1 | 6/2006 | Lyddon et al. |
| 2006/0260210 | A1 | 11/2006 | Tanielian et al. |
| 2007/0264079 | A1 | 11/2007 | Martinez et al. |
| 2008/0060271 | A1 | 3/2008 | Beniamin et al. |
| 2008/0124171 | A1 | 5/2008 | Moormeier et al. |
| 2009/0163095 | A1 | 6/2009 | Weinel et al. |
| 2010/0086349 | A1 | 4/2010 | Martinez et al. |
| 2010/0196092 | A1 | 8/2010 | Castro et al. |
| 2010/0221066 | A1 | 9/2010 | Martinez et al. |

FOREIGN PATENT DOCUMENTS

| | | | |
|---|---|---|---|
| CN | 2680722 | Y | 2/2005 |
| WO | WO-2009090370 | A1 | 7/2009 |

OTHER PUBLICATIONS

International Search Report and Written Opinion, International Application No. PCT/US2010/053425, Filed on Oct. 20, 2010, Applicant: Pacific Scientific Energetic Materials Company, Mailed on Dec. 13, 2010, 11 pages.

International Search Report and Written Opinion, International Application No. PCT/US2010/053428, Filed on Oct. 20, 2010, Applicant: Pacific Scientific Energetic Materials Company, Mailed on Dec. 13, 2010, 8 pages.

International Search Report and Written Opinion; International Patent Application No. PCT/US09/59554; Filed Oct. 5, 2009; Applicant: Pacific Scientific Energetic Materials Corporation; Mailed on Dec. 4, 2009.

Yates, Travis, "Tire Deflation Devices Help Put An End To Pursuits," PoliceOne.com News, 2 pages, Dec. 20, 2007.

APPARATUS AND METHOD FOR DISABLING A GROUND ENGAGING TRACTION DEVICE OF A LAND VEHICLE

CROSS-REFERENCE TO RELATED APPLICATION(S)

This patent application is a continuation-in-part of U.S. patent application Ser. No. 12/537,224, filed on Aug. 6, 2009, which claims the benefit under 35 U.S.C. §119 of U.S. Provisional Patent Application No. 61/195,281, filed on Oct. 6, 2008, entitled "Remotely Deployed Vehicle Restraint Device." Both of these applications are incorporated herein in their entirety by reference.

TECHNICAL FIELD

The present disclosure relates generally to an apparatus and a method for slowing, disabling, immobilizing and/or restricting the movement of a land vehicle. More particularly, the present disclosure relates to an apparatus and a method of deploying and retracting a strap for disabling a pneumatic tire, an airless tire, an endless track, or another ground engaging traction device of a land vehicle. Certain embodiments according to the present disclosure may include a strap that is deployed by compressed gas, pressure generated by a gas generator, resilient elements, of other types of potential energy sources that can be fired multiple times without recharging. The strap includes spikes, caltrops, explosive charges, or other objects that project upwardly and are configured to penetrate a tire of a vehicle and allow the egress of air from a pneumatic tire.

BACKGROUND

Conventional devices for slowing, disabling, immobilizing and/or restricting the movement of a land vehicle include barriers, tire spike strips, caltrops, snares and electrical system disabling devices. For example, conventional spike strips include spikes projecting upwardly from an elongated base structure that is stored as either a rolled up device or an accordion type device. These conventional spike strips are unfurled or unfolded and placed on a road in anticipation that an approaching target vehicle will drive over the spike strip. Successfully placing a conventional spike strip in the path of a target vehicle results in one or more tires of the target vehicle being impaled by the spike(s), thereby deflating the tire(s) and making the vehicle difficult to control such that the driver is compelled to slow or halt the vehicle.

Conventional spike strips may be used by first response personnel, law enforcement personnel, armed forces personnel or other security personnel. It is frequently the case that these personnel must remain in close proximity when deploying spike strips. For example, a conventional method of deploying a spike strip is to have the personnel toss the spike strip in the path of an approaching target vehicle. This conventional method places the security personnel at risk insofar as the driver of the target vehicle may try to run down the security personnel or the driver may lose control of the target vehicle while attempting to maneuver around the spike strip and hit the security personnel. Further, rapidly deflating only one of the steering tires may cause a target vehicle to careen wildly and possibly strike nearby security personnel, bystanders, or structures.

There are a number of disadvantages of conventional spike strips including difficulty deploying the strip in the path of a target vehicle and the risk that one of the spikes could injure security personnel while deploying or retracting the strip. The proximity of the security personnel to the target vehicle when it runs over strip places the security personnel at risk of being struck by the target vehicle. Further, allowing the strip to remain deployed after the target vehicle passes the strip places other vehicles at risk of running over the strip.

DETAILED DESCRIPTION

Specific details of embodiments according to the present disclosure are described below with reference to devices for slowing, disabling, immobilizing and/or restricting the movement of a land vehicle. Other embodiments of the disclosure can have configurations, components, features or procedures different than those described in this section. A person of ordinary skill in the art, therefore, will accordingly understand that the disclosure may have other embodiments with additional elements, or the disclosure may have other embodiments without several of the elements shown and described below with reference to FIGS. 1-8D.

Figure 1:
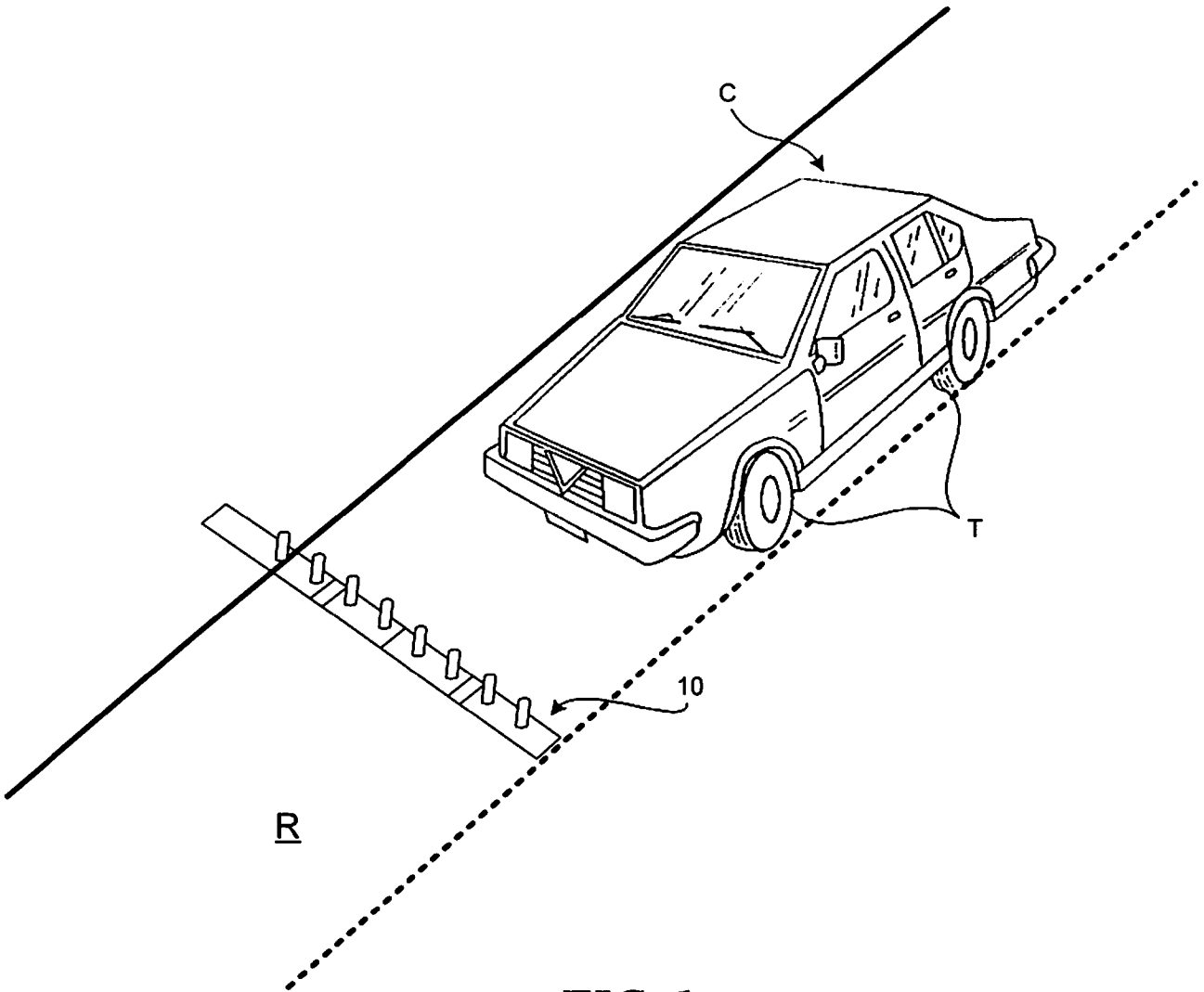
FIG. 1 is a schematic perspective view of a land vehicle approaching a device according to an embodiment of the present disclosure.

FIG. 1 is a schematic perspective view of a land vehicle approaching a device 10 according to an embodiment of the present disclosure. First response personnel, law enforcement personnel, armed forces personnel or other security personnel may use the device 10 to slow, disable, immobilize and/or restrict the movement of the land vehicle. Examples of land vehicles may include cars, trucks, tracked vehicles such as bulldozers or tanks, or any other vehicles that use pneumatic tires, airless tires, endless tracks, or other ground engaging traction devices to accelerate, steer, or support the land vehicle. The term "ground" may refer to natural or manmade terrain including improved roadways, gravel, sand, dirt, etc. FIG. 1 shows a car C supported, steered, and/or accelerated by pneumatic tires T relative to an improved roadway R.

Certain embodiments according to the present disclosure deploy the device 10 in the expected pathway of a target vehicle, e.g., the car C. The undeployed device 10 may be placed on the ground, e.g., on or at the side of the road R, and then armed. For example, the device 10 can be armed by making a power source available in anticipation of deploying the device 10. The device 10 is deployed, e.g., extended across the expected pathway of the target vehicle, as the vehicle approaches the device 10. The device 10 may be deployed when the target vehicle is a short distance away, e.g., less than 100 feet. This may avoid alerting the driver to the presence of the device 10 and thus make it more likely that the target vehicle will successfully run over the device 10. Similarly, remotely or automatically deploying the device 10 may reduce the likelihood that the driver will notice the device 10 or take evasive action to avoid running over the device 10. Remotely deploying the device 10 also allows the device operator (not shown) to move away from the target vehicle and thereby reduce or eliminate the likelihood of the vehicle striking the operator.

Figure 2A:
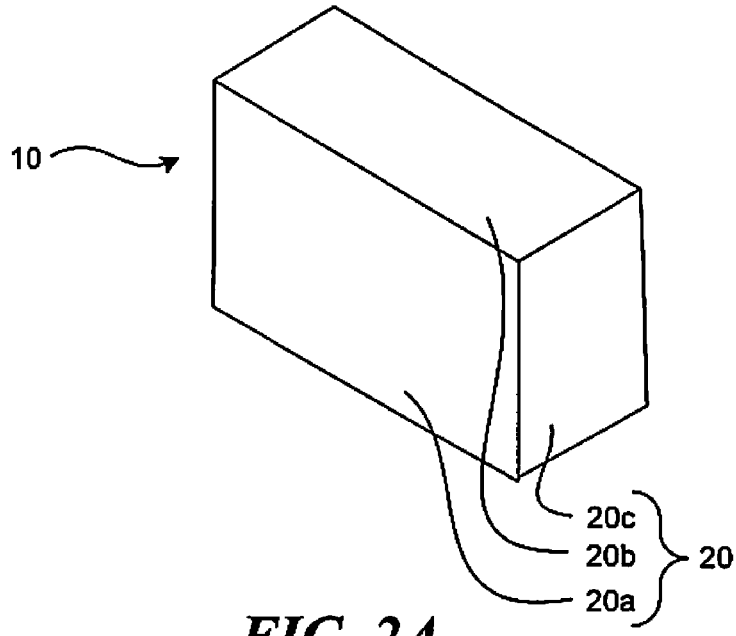
FIGS. 2A-2D are schematic perspective views showing a device according to an embodiment of the present disclosure in an unarmed arrangement, an armed arrangement, and a deployed arrangement, respectively.
Figure 2B:
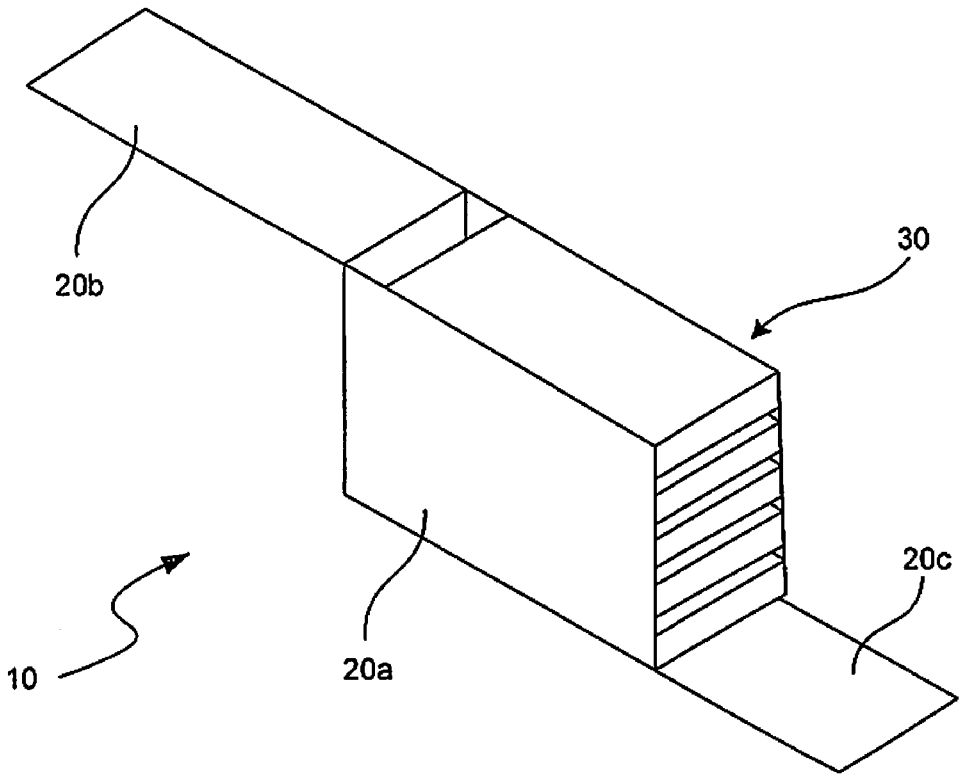
Figure 2C:
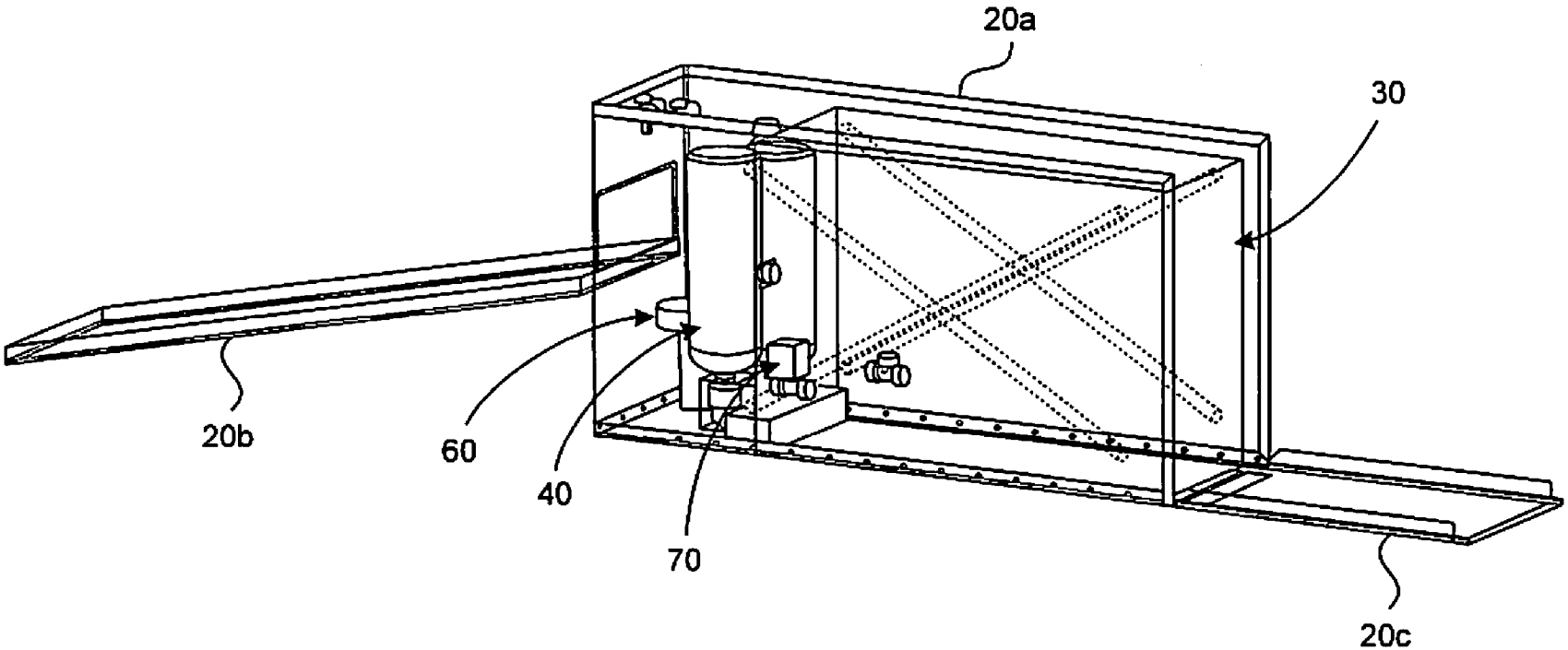
Figure 2D:
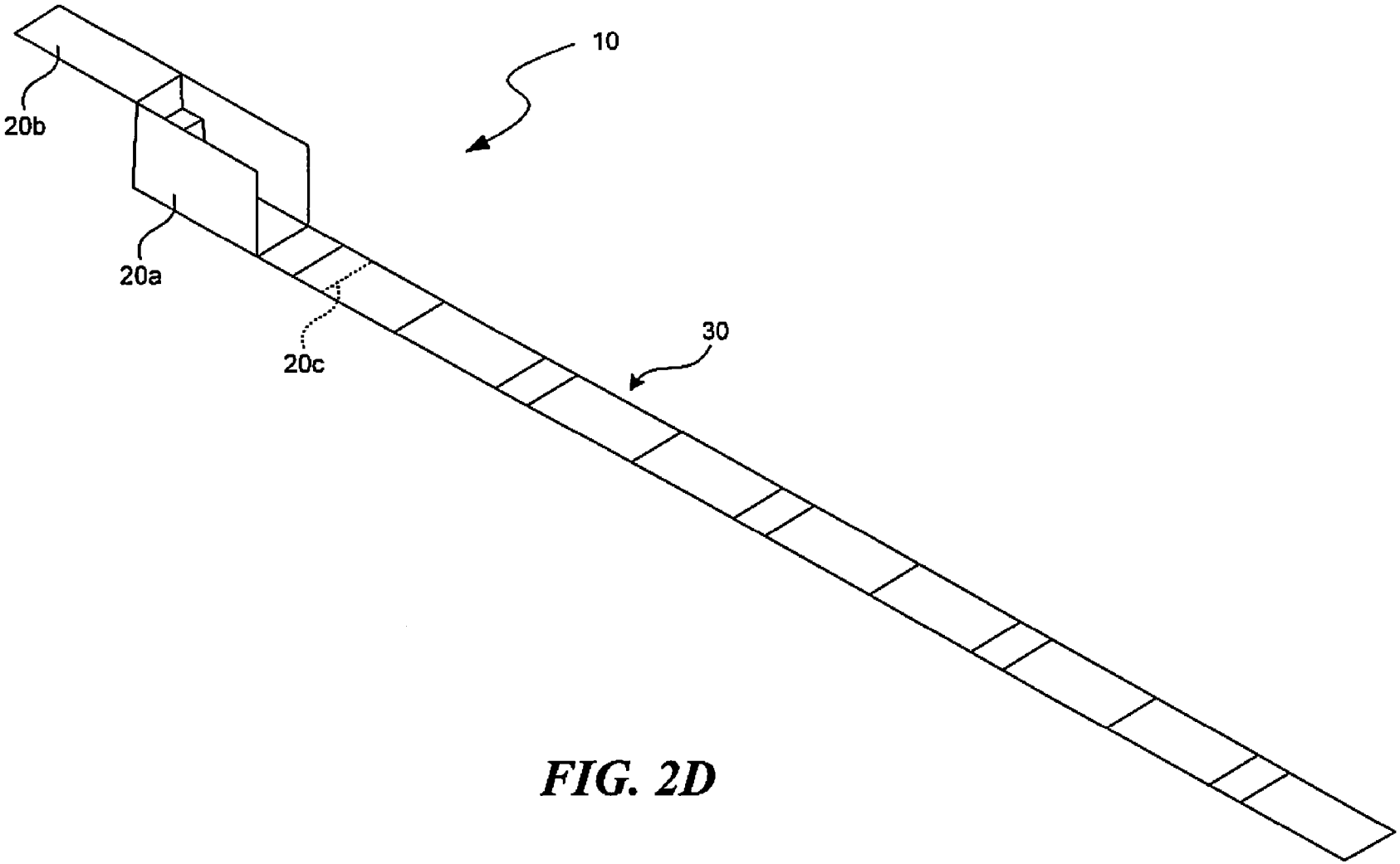

FIGS. 2A-2D are schematic perspective views showing the device 10 in an undeployed arrangement (FIG. 2A), an armed arrangement (FIGS. 2B and 2C), and a deployed arrangement (FIG. 2D). FIG. 2A shows an embodiment according to the present disclosure including a housing 20 for storing, transporting and/or handling the device 10 in the undeployed arrangement. In particular, the housing 20 may include a bottom portion 20*a* coupled to a top portion 20*b* and a front portion 20*c* in an ammunition box type configuration. Opening the housing 20 (FIG. 2B) and/or another action, e.g., tripping a switch, may arm the device 10. FIG. 2C is a partially transparent view showing a strap package 30, an inflation device 40, a retractor device 60, and a power source 70, e.g., a battery pack, according to an embodiment of the present disclosure with the housing 20 opened. Once armed, the device 10 is ready to be deployed. As the target vehicle approaches the device 10, the strap package 30 is deployed (FIG. 2C) such that the strap package 30 is unfolded or unfurled in the expected path of the target vehicle. According to one embodiment of the present disclosure, the dimensions of the housing 20 can be approximately 8" wide, approximately 14" tall, and approximately 28" long in the undeployed arrangement (FIG. 2A). The weight of the device 10 can be approximately 40 pounds and the housing 20 can be painted olive drab, similar to an ammunition box.

Figure 3A:
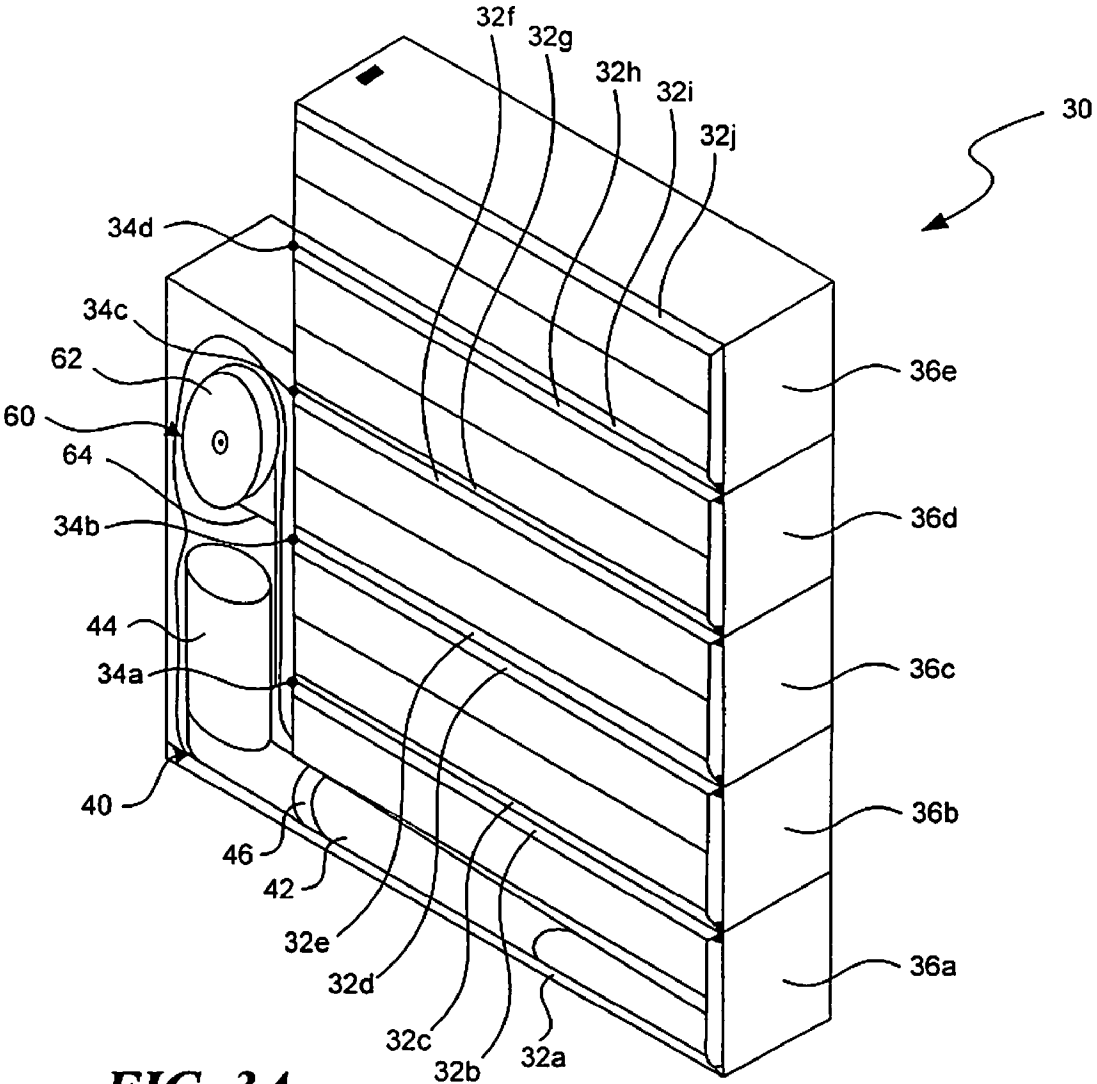
FIG. 3A is a perspective view of a strap package including an inflator device and a retractor device according to an embodiment of the present disclosure before the device is deployed.

FIG. 3A is a perspective view of the strap package 30 including the inflator device 40 and the retractor device 60 according to an embodiment of the present disclosure before the device 10 is deployed. The strap package 30 includes a plurality of plates 32 (ten plates 32*a*-32*j* are shown in FIG. 3A) that are pivotally coupled by alternating first and second joints. Individual first joints 34 (four first joints 34*a*-34*d* are shown in FIG. 3A) include a single pivot axis between adjacent plates 32, and individual second joints 36 (five second joints 36*a*-36*e* are shown in FIG. 3A) include two separate pivot axes spaced by a link between adjacent plates 32. According to the embodiment shown in FIG. 3A, second joint 36*a* pivotally couples plates 32*a* and 32*b*, first joint 34*a* pivotally couples plates 32*b* and 32*c*, second joint 36*b* pivotally couples plates 32*c* and 32*d*, first joint 34*b* pivotally couples plates 32*d* and 32*e*, second joint 36*c* pivotally couples plates 32*e* and 32*f*, first joint 34*c* pivotally couples plates 32*f* and 32*g*, second joint 36*d* pivotally couples plates 32*g* and 32*h*, first joint 34*d* pivotally couples plates 32*h* and 32*i*, and second joint 36*e* pivotally couples plates 32*i* and 32*j*. Accordingly, the strap package 30 includes an articulated series of plates 32 and joints 34 and 36. The second joints 36 may alternatively be viewed as "shorter" plates with individual pivot axes that couple the shorter plates to adjacent "longer" plates 32.

The undeployed or stacked arrangement of the strap package 30 shown in FIG. 3A includes the plates 32*a* through 32*j* overlying one another. In particular, plate 32*j* overlies plate 32*i* (they are separated by second joint 36*e*), plate 32*i* directly overlies plate 32*h* (they are coupled by first joint 34*d*), plate 32*h* overlies plate 32*g* (they are separated by second joint 36*d*), plate 32*g* directly overlies plate 32*f* (they are coupled by first joint 34*c*), plate 32*f* overlies plate 32*e* (they are separated by second joint 36*c*), plate 32*e* directly overlies plate 32*d* (they are coupled by first joint 34*b*), plate 32*d* overlies plate 32*c* (they are separated by second joint 36*b*), plate 32*c* directly overlies plate 32*b* (they are coupled by first joint 34*a*), and plate 32*b* overlies plate 32*a* (they are separated by second joint 36*a*). The spaces between the plates 32 due to the separation provided by the second joints 36 accommodate penetrators that are coupled to the plates 32 as will be discussed in greater detail below.

The plates 32 and/or the second joints 36 can include fiberglass, corrugated plastic or cardboard, wood, or another material that is suitably strong and lightweight. For example, G10 is an extremely durable makeup of layers of fiberglass soaked in resin that is highly compressed and baked. Moreover, G10 is impervious to moisture or liquid and physically stable under climate change. The plates 32 provide a platform suitable for delivering the spikes, caltrops, explosive charges, etc. that penetrate a tire of a target vehicle. Accordingly, the size and shape of the plates 32 may be selected to provide adequate support on lose or unstable ground, e.g., sand. For example, a six-inch by 17.5 inch plate made from 1/32 inch thick G-10 can provide a suitable platform. The size of the plates 32 may also affect how far the strap package 30 extends in the deployed arrangement, e.g., shorter plates 32 may result in a shorter strap package 30 being deployed.

Figure 4:
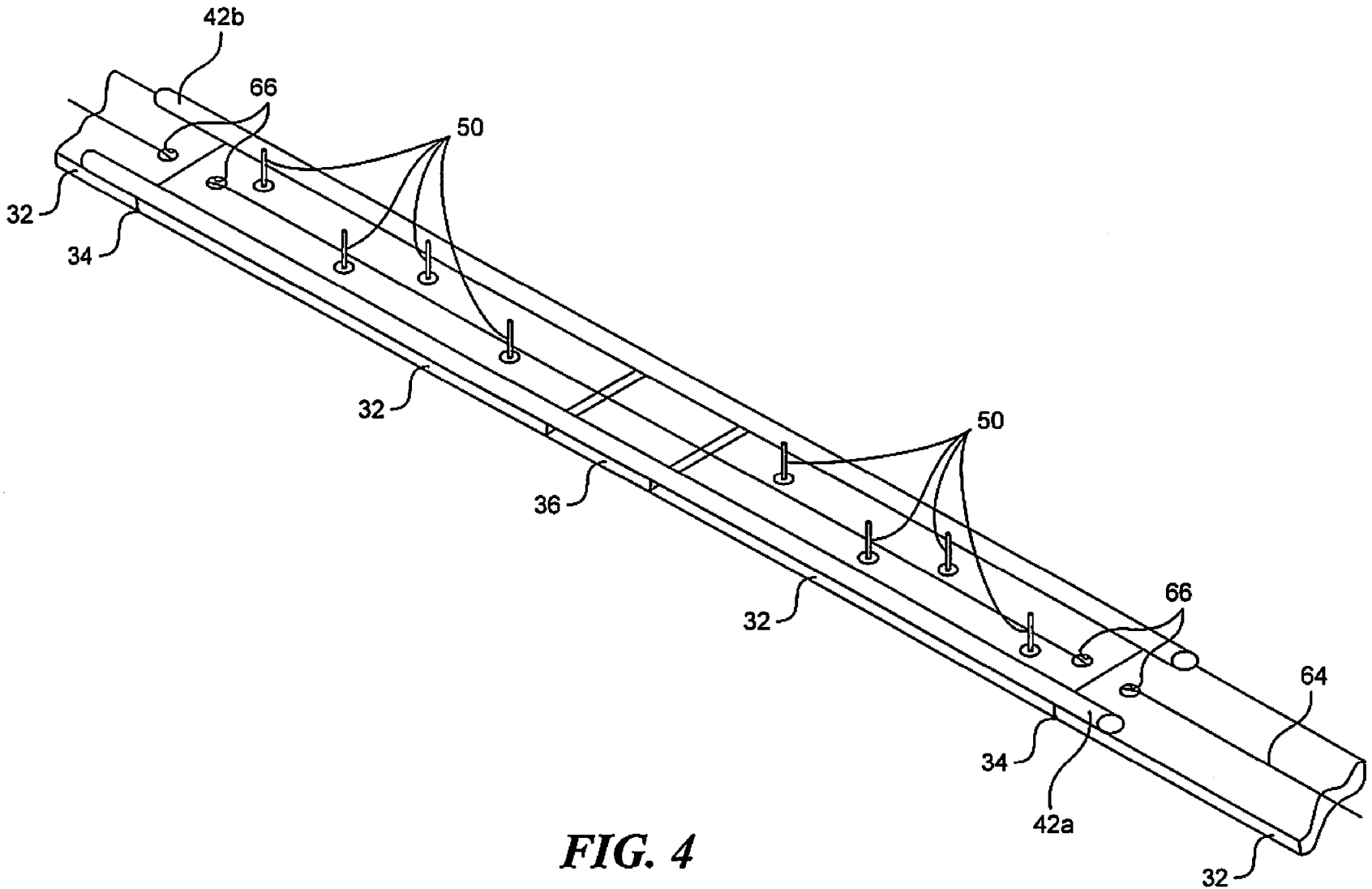
FIG. 4 is a detail view of a portion of the strap package of FIG. 3 after the strap package is deployed.

The inflator device 40 includes inflatable bladders 42 (two inflatable bladders 42*a* and 42*b* are shown in FIG. 4) that are also accommodated in the spaces between the plates 32 due to the separation provided by the second joints 36. The inflator device 40 additionally includes a pressure source 44, e.g., a pressurized gas cylinder, gas generator, an accumulator, etc., and a manifold 46 coupling the pressure source 44 to the bladders 42. The bladders 42 are mounted to the plates 32 and, in response to being inflated by the pressure source 44, expand to deploy the strap package 30. Certain embodiments according to the present disclosure include tubular bladders 42 mounted lengthwise along the plates 32 such that, in the stacked arrangement of the strap package 30, the bladders 42 are temporarily creased at the first and second joints 34 and 36. Accordingly, each bladder 42 defines a series of chambers that may be sequentially inflated starting at the end of the bladder 42 coupled to the manifold 46. As each chamber is inflated, the expanding bladder unstacks, e.g., unfolds, unfurls, or otherwise begins to deploy, adjacent overlying plates 32 until the bladders 42 are approximately fully expanded and the strap package is deployed, e.g., as shown in FIG. 2C. The pivot axes of the first and second joints 34 and 36 may assist in constraining the strap package 30 to deploying in a plane, e.g., minimizing or eliminating twisting by the strap package 30 about its longitudinal axis when it is being deployed.

The inflator device 40 may also include a sensor (not shown) for sensing an approaching vehicle and automatically deploying the strap package 30. Examples of suitable sensors may include magnetic sensors, range sensors, or any other device that can sense an approaching vehicle and deploy the strap package 30 before of the vehicle arrives at the device 10. The inflator device 40 may alternatively or additionally include a remote actuation device (not shown) for manually deploying the strap package 30. The sensor and/or the remote actuation device may be coupled to the device 10 by wires, wirelessly, or another communication system for conveying a "deploy signal" to the device 10. Examples of wireless communication technology include electromagnetic transmission (e.g., radio frequency) and optical transmission (e.g., laser or infrared).

Figure 3B:
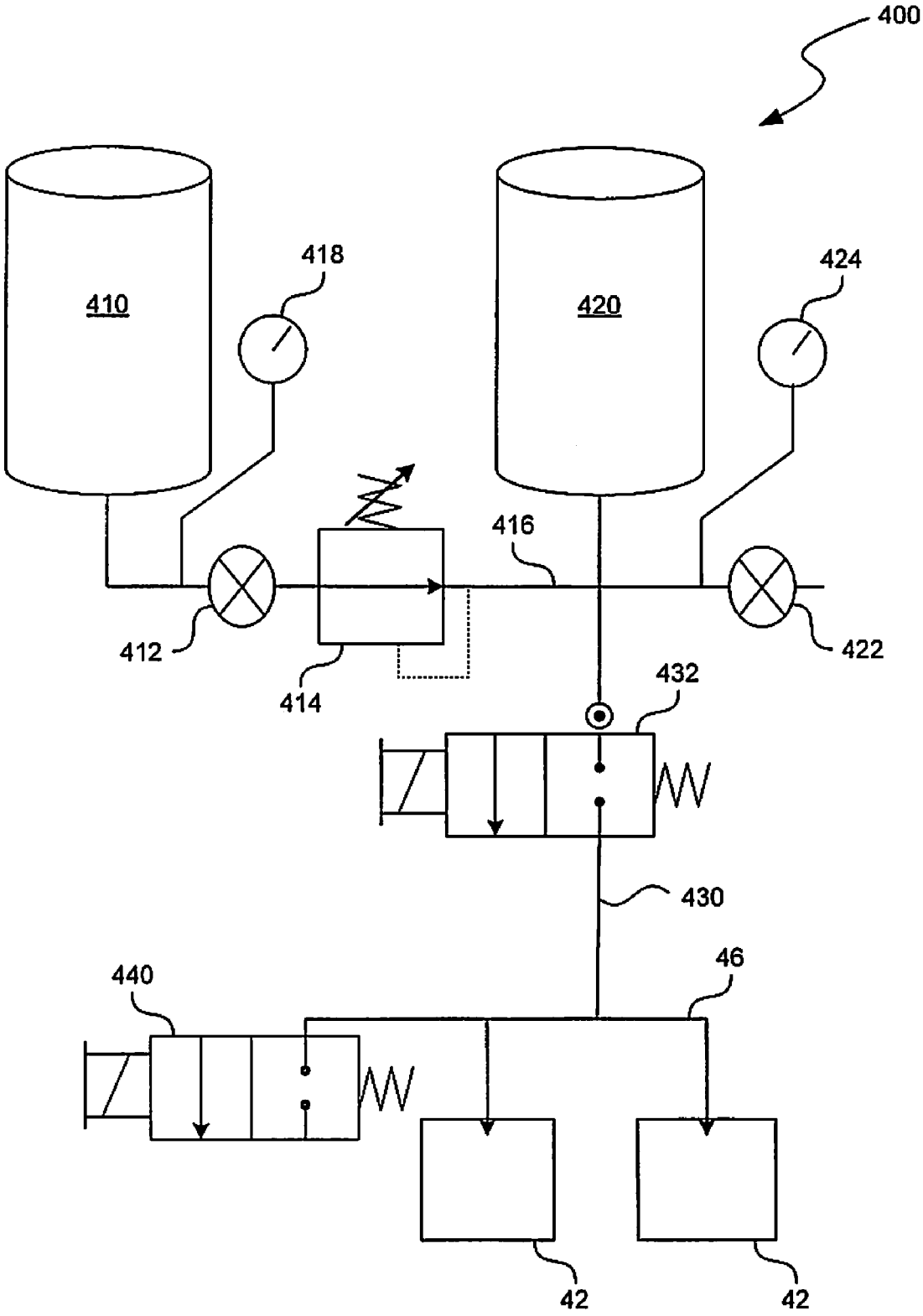
FIG. 3B is a schematic view of an inflator device according to an embodiment of the present disclosure.

FIG. 3B is a schematic view of a multiple discharge, cold gas inflator device 400 according to an embodiment of the present disclosure. The inflator device 400 shown in FIG. 3B includes a high pressure reservoir 410 for supplying a compressed gas, e.g., nitrogen, to an accumulator tank 420. The supply of compressed gas can be controlled by a supply valve 412 and/or a pressure regulator 414 along a supply line 416 coupling the high pressure reservoir 410 and the accumulator tank 420. The supply valve 412 can supply or shutoff a flow of the compressed gas from the high pressure reservoir 410 through the supply line 416. According to certain embodiments of the present disclosure, the high pressure reservoir 410 can have a volume of approximately 50 cubic inches ($in^3$) and can be initially pressurized to approximately 3,000 pounds per square inch (psi). The accumulator tank 420 can have a volume less than, similar to, or greater than that of the high pressure reservoir 410. For example, certain embodiments of the present disclosure can include an accumulator tank 420 having a slightly larger volume, e.g., approximately 62 $in^3$, and the pressure regulator 414 can be adjusted to pressurize the accumulator tank 420 to a relatively lower pressure, e.g., to approximately 600 psi. In general, the volume and pressure of the accumulator tank 420 may be related to the volume of the bladders 42 and the desired time for deploying the strap package 30 with the bladders 42. For example, greater deployment pressure and/or volume may reduce the time it takes to deploy the strap package 30 whereas lower deployment pressure and/or volume may provide a more controlled deployment of the strap package 30. A gauge 418 can be coupled to the supply line 416 between the high pressure reservoir 410 and the supply valve 412 to indicate the pressure in the high pressure reservoir 410. Certain other embodiments may use a different gas or mixture of gases, may include reservoirs or tanks with different volume (s), may include fixed or adjustable pressure regulators, and/or may use different pressure(s).

A drain valve 422 coupled to the supply line 416 downstream of the accumulator tank 420 can drain residual pressure in the accumulator tank 420 by opening the supply line 416 to the atmosphere. A gauge 424 can be coupled to the supply line 416 between the supply valve 412 and the drain valve 422 to indicate the pressure in the accumulator tank 420.

Compressed gas for deploying the strap package 30 can flow along a deployment line 430 that couples the supply accumulator tank 420 and the manifold 46. A deployment valve 432 is positioned along the deployment line 430 between the supply accumulator tank 420 and the manifold 46 to control flow of the compressed gas to the strap package 30. According to certain embodiments of the present disclosure, the deployment valve 432 can include a 0.5 inch NPT normally closed solenoid valve with an approximately 15 millimeter orifice, a 1500 psi pressure capability, and can be actuated by a direct current signal, e.g., 24 volts. A signal to deploy the strap package 30 energizes the solenoid of the deployment valve 432 to allow compressed gas in the accumulator tank 420 to flow through the deployment line 430 and the manifold 46 to the bladders 42, thereby deploying the strap package 30. A vent valve 440 coupled to the deployment line 430 downstream of the deployment valve 432 and/or coupled to the manifold 46 can vent compressed gas in the bladders 42 to the atmosphere. According to certain embodiments of the present disclosure, the vent valve 440 can include a 0.125 inch NPT normally closed solenoid valve with an approximately 1.2 millimeter orifice and can also be actuated by a 24 volt direct current signal. A signal to vent the bladders 42 energizes the solenoid of the vent valve 440 to release to atmosphere the gas in the bladders 42, for example, before and/or during operation of the retractor device 60.

Figure 3C:
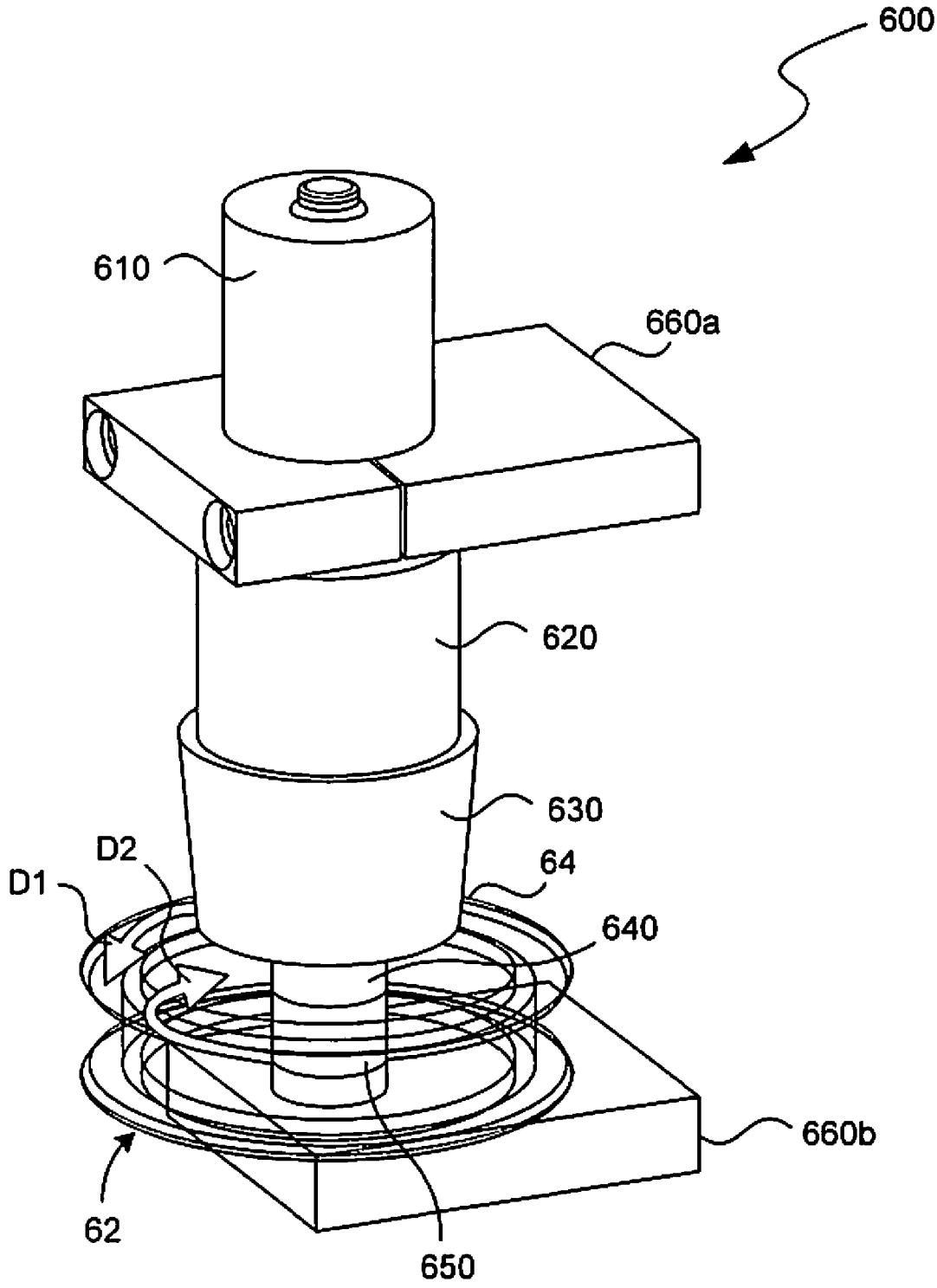
FIG. 3C is a detail view showing a retractor device according to an embodiment of the present disclosure.

FIG. 3C is a perspective view of a retractor device 600 according to an embodiment of the present disclosure. The retractor device 600 may be electrically, pneumatically, mechanically (e.g., with a resilient element such as a torsion spring), or otherwise powered. The retractor device 600 shown in FIG. 3C includes a torque source 610, e.g., an electric motor, a torque multiplier 620, e.g., reduction gearing, a torque limiter 630, e.g., a friction plate slip-clutch, a coupling 640, and a one-way clutch 650, e.g., a drawn cup needle clutch bearing. One or more brackets 660 (two brackets 660*a* and 660*b* are shown in FIG. 3C) may support the retractor device 600 with respect to the housing 20. Certain embodiments of the retractor device 600 can include a 60-80 Watt direct current electric motor 610 rated at 3000 revolutions per minute and a 6:1 ratio planetary gear reducer 620. The coupling 640 can be a steel mandrel for transferring driving torque to a drive pulley 62 for winding a cable 64 on the drive pulley 62. An example of a drawn cup needle clutch bearing is part number RC-081208 manufactured by The Timken Company of Camden, Ohio. The one-way clutch 650 may be interposed between the coupling 640 and the drive pulley 62. Accordingly, operating the torque source 610 engages the one-way clutch 650 thereby driving the drive pulley 62 and winding the cable 64 onto the drive pulley 62 to retract the strap package 30. Moreover, the one-way clutch 650 allows the drive pulley 62 to turn generally freely to allow the cable 46 to pay-out when, for example, the strap package 30 is being deployed.

The electronics for the control of the device 10 can include at least two options for triggering deployment: (1) a wireless frequency operated button ("FOB") and/or (2) a wired control box. Embodiments of option 1 according to the present disclosure can include a three-channel, 303 MHz wireless radio frequency board (e.g., Model Number RCR303A manufactured by Applied Wireless, Inc. of Camarillo, Calif.) in the housing 20 and a three-button FOB (e.g., Key Chain Transmitter KTX303Ax also manufactured by Applied Wireless, Inc.) that can be separated and remotely located from the housing 20. Embodiments of option 2 according to the present disclosure can include a control box that can be separated and remotely located from the housing 20 but remains electrically coupled via a cable. Both options may be incorporated into the device 10 to provide a backup for controlling deployment of the strap package 30.

Figure 3D:
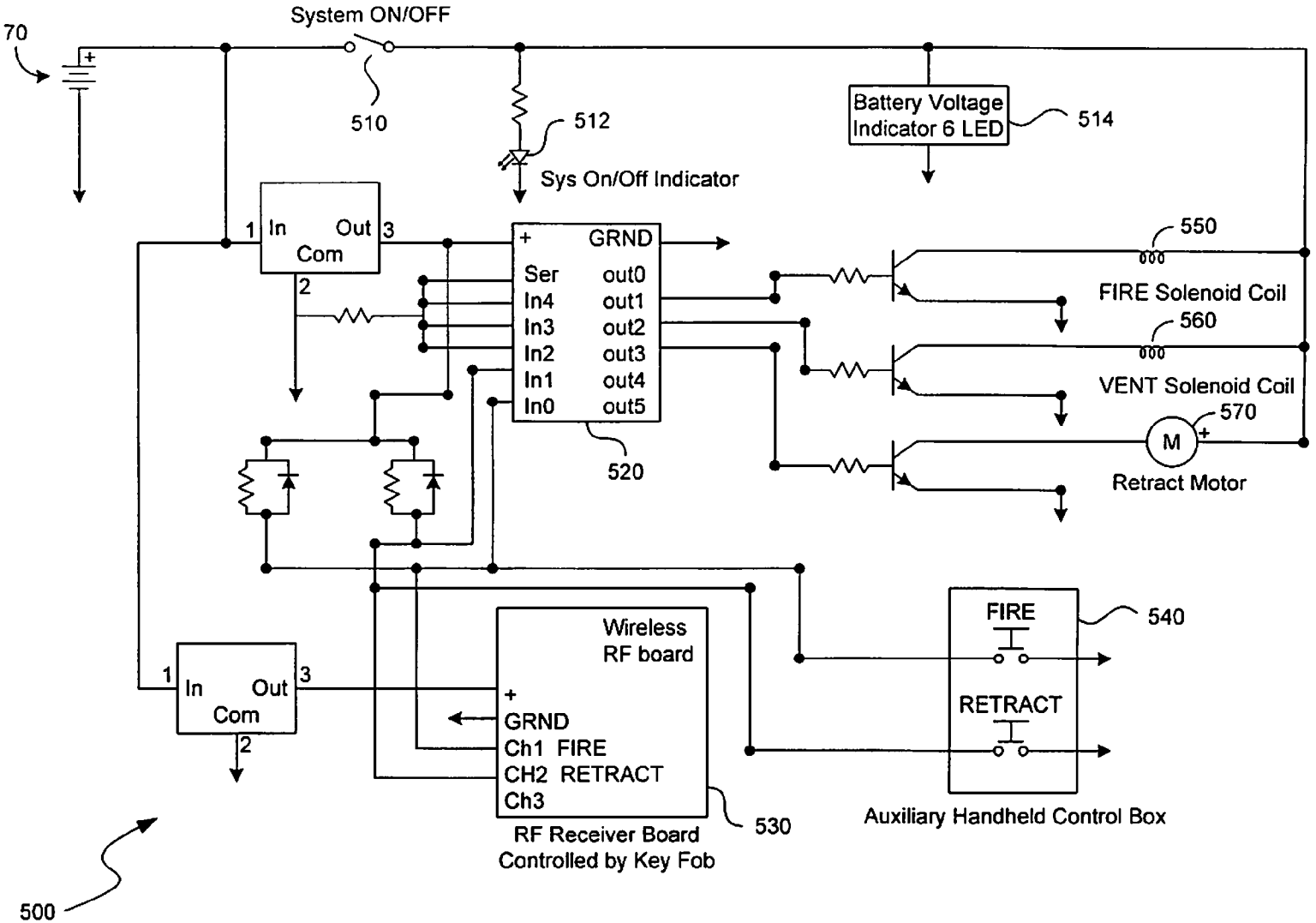
FIG. 3D is a schematic diagram showing a control system according to an embodiment of the present disclosure.

FIG. 3D is a schematic diagram of an electronic circuit 500 for controlling the inflator device 400 and the retractor device 600 according to an embodiment of the present disclosure. The electronic circuit 500 shown in FIG. 3D includes the power supply 70, e.g., a 24 volt direct current battery, and a system switch 510 for turning ON/OFF the device 10. The electronic circuit 500 may also include a first indicator 512 for showing the status of the device 10 based on the setting of the system switch 510 and a second indicator 514 for showing the voltage of the power supply 70. A microprocessor 520 receives input signals, e.g., "FIRE" and "RETRACT," from a wireless radio frequency board 530 (i.e., option 1) and/or an auxiliary handheld control box 540 (i.e., option 2) and sends output signals to (a) a solenoid coil 550 for the deployment valve 432, (b) a solenoid coil 560 for the vent valve 440, and/or (c) a motor winding 570 for the torque source 610.

The electronic circuit 500 can also include circuitry to handle the timing and control of operational events. Such a circuit may be useful if, for example, there is a difference in voltage provided by the wired control box 540 (e.g., approximately 14-17 volts direct current) verses the voltage required to operate the deployment valve 432 and/or vent valve 440 (e.g., approximately 24 volts direct current). This other circuit operates based on operator input for each event from either the wireless radio frequency board 530 (i.e., option 1) and/or the wired control box 540 (i.e., option 2).

Figure 3E:
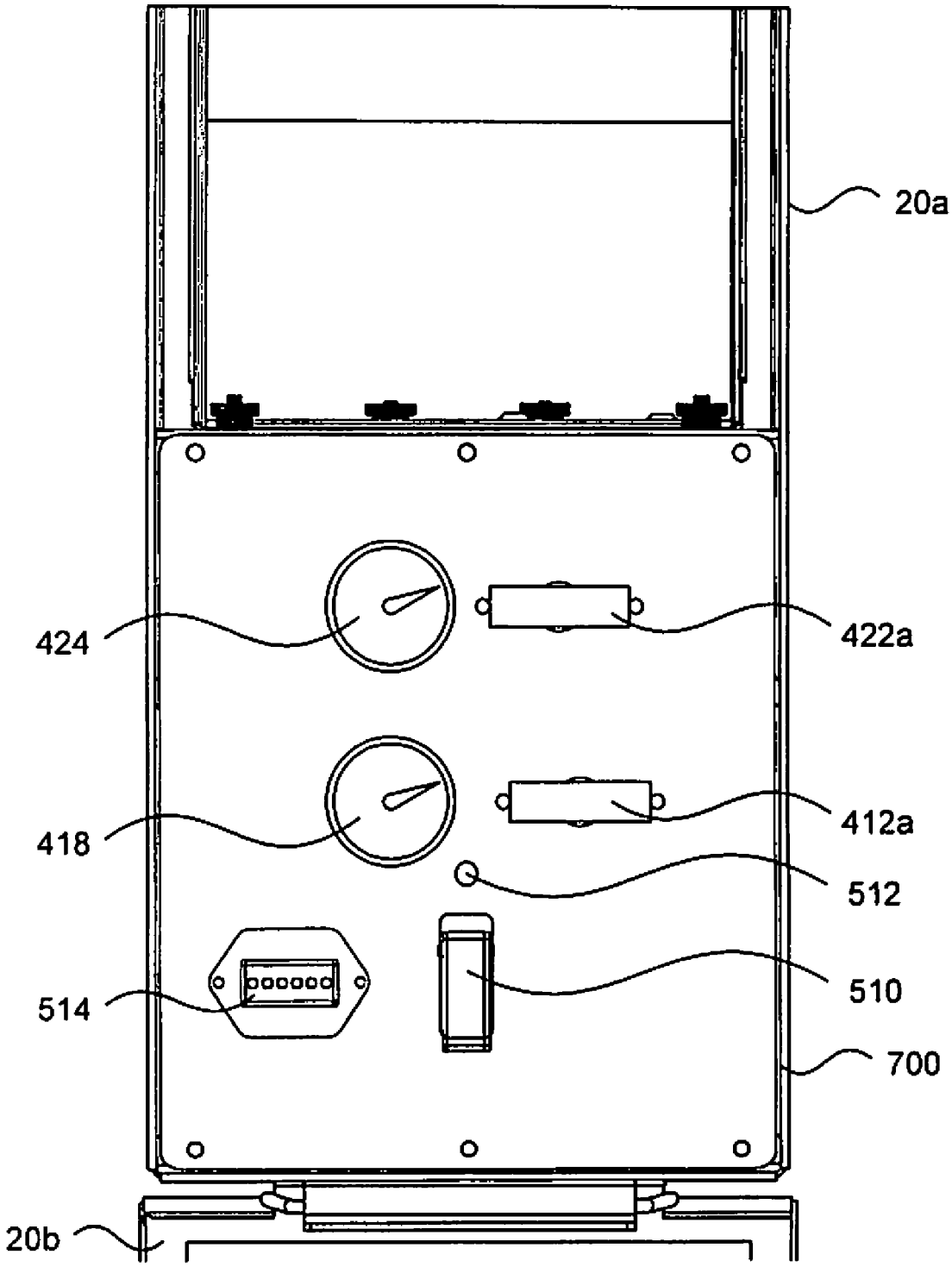
FIG. 3E is a partial plan view showing a control panel according to an embodiment of the present disclosure.

FIG. 3E is a partial plan view showing a control panel 700 according to an embodiment of the present disclosure. The control 700 can be coupled to the housing 20 and include the gauge 418 to indicate the pressure in the high pressure reservoir 410, the gauge 424 to indicate the pressure in the accumulator tank 420, the second indicator 514 for showing the voltage of the power supply 70, the system switch 510, the first indicator 512 for showing the ON/OFF status of the device 10 based on the setting of the system switch 510, a knob 412*a* operating the supply valve 412 to supply or shutoff the flow of the compressed gas from the high pressure reservoir 410, and a knob 422*a* operating the drain valve 422 to drain residual pressure in the accumulator tank 420 and purge the inflator device 400, for example, when storing the device 10.

FIG. 4 is a detail view of a portion of the strap package 30 after being deployed. As the target vehicle drives onto or over the deployed strap package 30, the tires of the target vehicle will engage penetrators 50, e.g., hollow spikes, barbs, hooks or other devices for penetrating and deflating a pneumatic tire. The number and distribution of penetrators 50 on the plates 32 can be varied as desired; however, increasing the number of penetrators 50 and/or decreasing the relative spacing between penetrators 50 are believed to increase the likelihood that at least one of the tires of the target vehicle will be impaled.

The penetrators 50 may alternately or additionally include one or more explosive charges (not shown). These charges, e.g., shaped charges such as linear shape charges, are suitable for rupturing or otherwise severing the tread or other components of pneumatic tires, airless tires, endless tracks, and/or other ground engaging traction devices of land vehicles. Such explosive charges may be triggered in response to sensing the weight of the target vehicle following deployment of the strap package 30, e.g., as described above. Certain embodiments of the penetrators 50 according to the present disclosure can include independent shaped charges and/or elongated linear shape charges that extend along individual plates 32. Moreover, the penetrators 50 can include combinations of spikes and charges. In operation, only the penetrators 50 that are engaged by the target vehicle are activated, e.g., spikes are picked up, charges explode, etc.

Certain embodiments according to the present disclosure may include hollow spikes to puncture and deflate pneumatic tires. Deflating one or more of the tires may cause the vehicle to become more difficult to control, e.g., deflating a tire used for steering may limit or prevent the ability of the target vehicle to maneuver and/or deflating a tire used for driving the target vehicle may limit or prevent accelerating or braking. Hollow spikes can be pulled from a spike holder (not shown in FIG. 4) on a plate 32 after the spikes contact and penetrate the tire. The hollow spike will then allow air in the tire to escape. The rate at which air escapes can be relatively rapid, e.g., with unimpeded air flow through the hollow spike, or relatively slow, e.g., with a valve or other flow restrictor (not shown) in the hollow spike.

Referring to FIGS. 3C and 4, the retractor device 60 includes the drive pulley 62 for winding in the cable 64. The retractor device 60 may be electrically, pneumatically, mechanically (e.g., with a resilient element such as a torsion spring), or otherwise powered. The cable 64 may alternatively or additionally include a monofilament line, a tape, or another suitable flexible tension device for retracting the strap package 30 from the deployed arrangement shown in FIG. 2C. Certain embodiments according to the present disclosure include the cable 64 running along the plates 32 and the second joints 36 in the stacked arrangement shown in FIG. 2B. The cable 64 is secured at one end to the winch 62, extends through holes 66, e.g., possibly lined by grommets (not shown), in the plates 32, and is secured at the other end to plate 32*j*. The holes 66 may be positioned proximate to the first joints 34. Accordingly, the cable 64 does not impede deploying the strap package 30 and draws the plates 32 into a retracted arrangement that is akin to the stacked arrangement of the plates 32 before they are deployed. A difference between the retracted and stacked arrangements is that the winch 62 has wound-in the cable 64 in the retracted arrangement. The retractor device 60 is used to retract the strap package 30 from the deployed arrangement shown in FIG. 2C under a variety of circumstances including, e.g., after the target vehicle has run over the device 10 but before a pursuit vehicle runs over the device 10 or after a predetermined time period has elapsed following an automatic deployment without a target vehicle running over the device 10. Certain embodiments of the retractor 600 according to the present disclosure may include a clutch, lock-release mechanism, and/or one way clutch 650 that allows the cable 64 to be freely unwound so that the plates 32 can be restacked and the cable 64 can be restrung for subsequent re-deployment. Certain other embodiments according to the present disclosure may include a cutting device for severing the cable 64 in the retracted arrangement. This would allow a secondary deployment of the device 10 even though the retractor 60 would not be able to retract the device 10 following the secondary deployment.

Figure 5A:
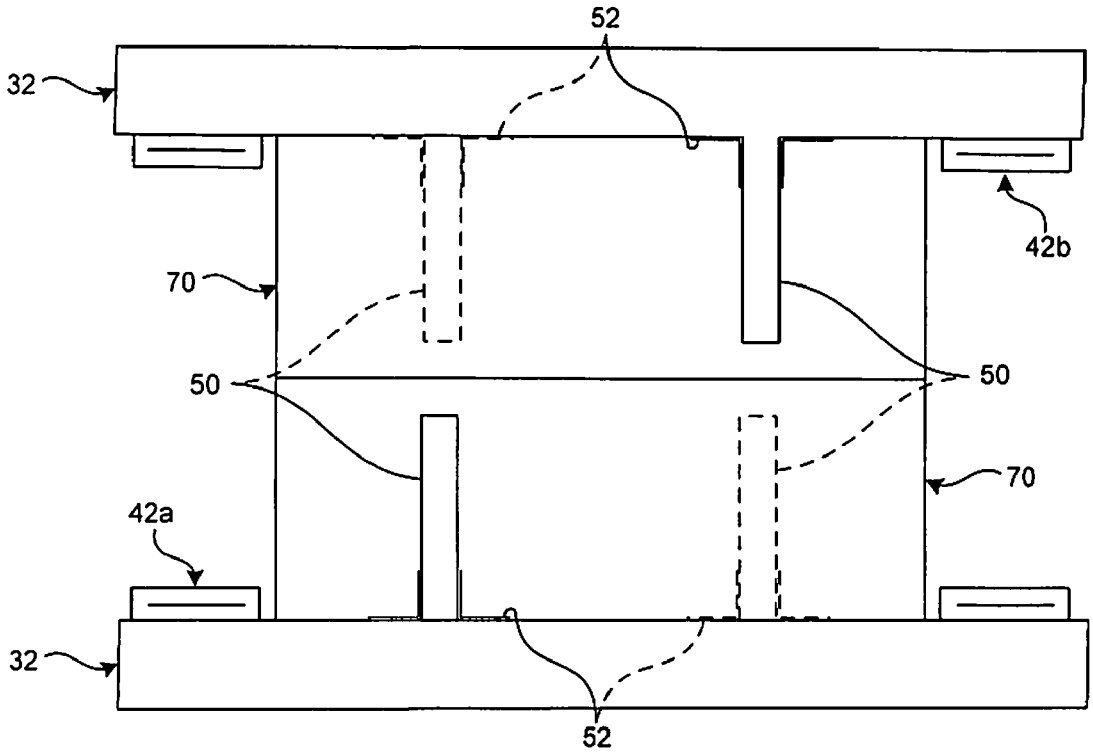
FIGS. 5A and 5B are cross-section views of devices according to embodiments of the present disclosure showing foam spike protectors.
Figure 5B:
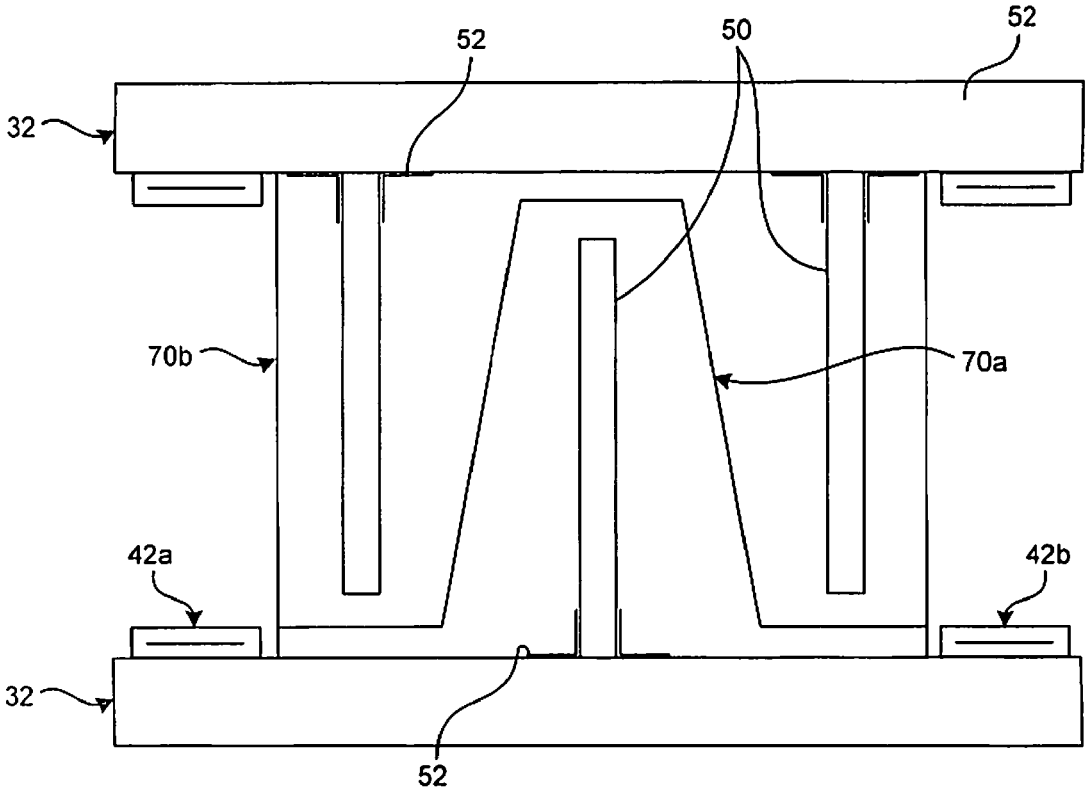

FIGS. 5A and 5B are cross-section views of the devices 10 including foam spike protectors 70. Deploying the strap package 30 involves flinging the plates 32 with the sharpened penetrators 50. The foam protectors 70 may reduce or prevent incidental contact with the penetrators 50. FIG. 5A shows an embodiment including blocks of foam, e.g., expanded polystyrene (EPS), coupled to the plates 32 so as to approximately encase the penetrators 50. Foams such as EPS are suitable materials because they are lightweight and they do not appreciably interfere with the penetrator 50 impaling a tire because the foam is readily crushed by the target vehicle. Other materials and configurations presenting similar characteristics may alternatively or additionally be used. FIG. 5B shows an alternative configuration in which interlocking foam protectors 70*a* and 70*b* are coupled to the adjacent plates 32 to either side of the second joints 36. The configuration shown in FIG. 5B allows longer penetrators 50 to be supported by the plates 32 as compared to the configuration shown in FIG. 5A. As discussed above, the plates 32 provide a support platform for the penetrators 50, even when the device is deployed on lose or unstable ground.

An additional advantage of the protectors 70 is retaining the penetrators 50 in holders 52 mounted on the plates 32. Accordingly, the protectors 70 can prevent the penetrators 50 from being prematurely released from the holders 52, e.g., before a tire of a target vehicle is impaled on one or more of the penetrators 50. Certain embodiments according to the present disclosure include penetrators 50 and/or holders 52 that are retained against or in contact with a plate 32. The penetrator 50 may be a hollow spike having a barbed tip that penetrates a pneumatic tire. Such a penetrator 50 may then be pulled from the holder 52 and allow air in the tire to exhaust through the hollow spike interior.

Figure 6:
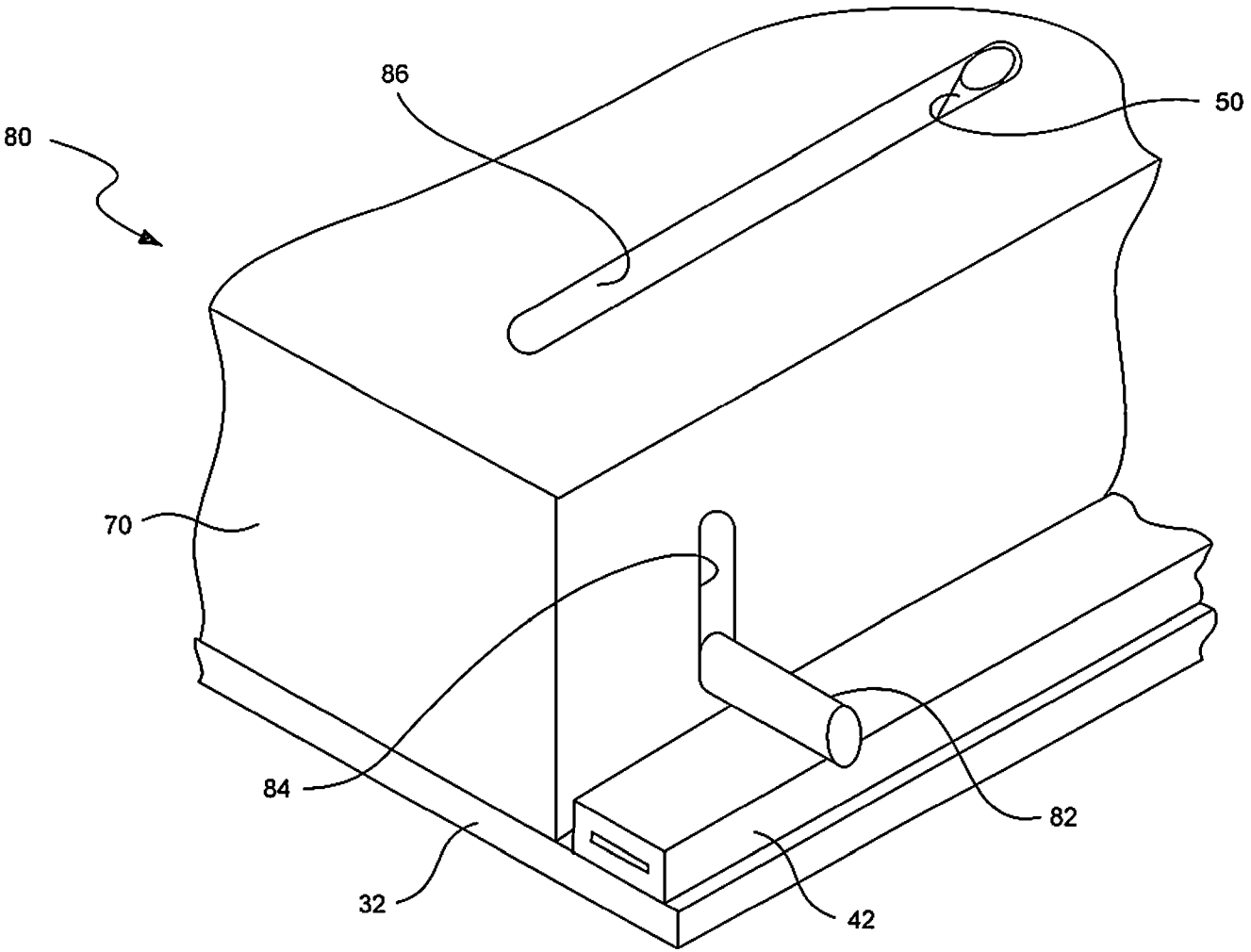
FIG. 6 is a partial perspective view of a device according to an embodiment of the present disclosure including a spike erector.

FIG. 6 is a partial perspective view of the device 10 including a spike erector 80. As was described with respect to FIG. 5B, longer penetrators 50 may be desirable. FIG. 6 shows an embodiment according to the present disclosure wherein a penetrator 50 includes, e.g., a hollow spike that extends from a sharp tip to a base pivotally coupled to an individual plate 32. A rod 82 may extend through a protector 70 to erect the penetrator 50 in response to inflating the bladder 42. In particular, the bladder 42 may drive the rod 82 in a slot 84 to drive the penetrator 50 from an oblique arrangement in the undeployed arrangement to an approximately orthogonal arrangement in the deployed arrangement of the device 10.

Figure 7A:
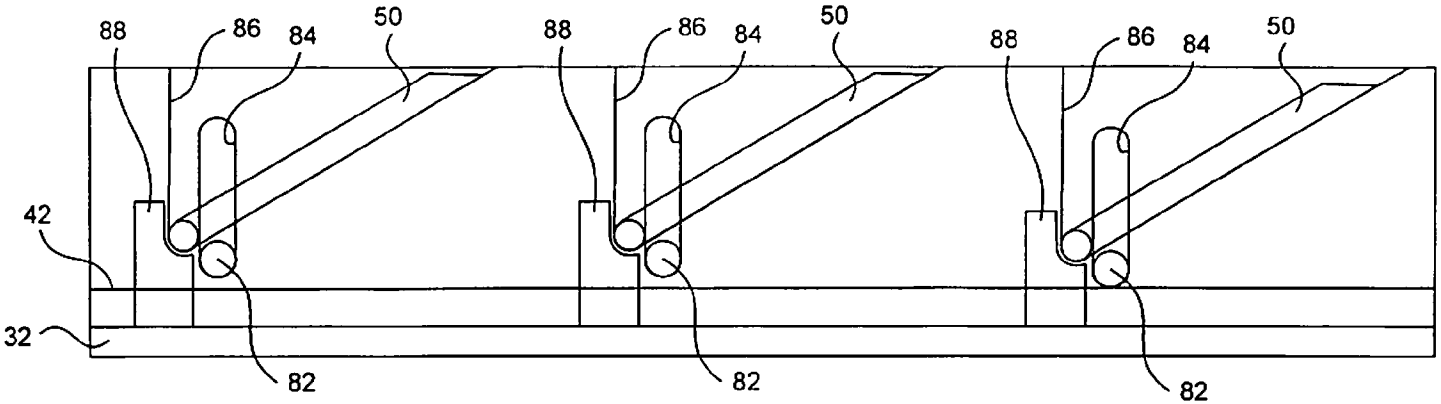
FIGS. 7A and 7B are schematic views illustrating the operation of the spike erector shown in FIG. 6.
Figure 7B:
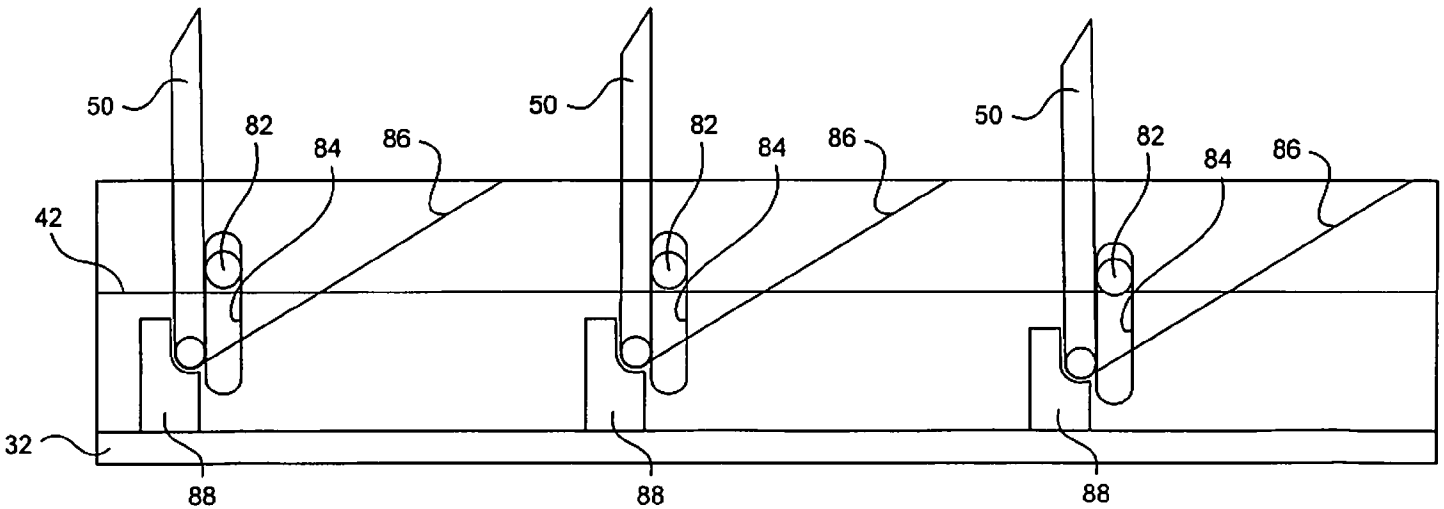

The operation of the erector 80 will be further described with additional reference to FIGS. 7A and 7B. In the undeployed arrangement of the device 10 shown in FIG. 7A, the bladder 42 is uninflated and three penetrators 50 are obliquely arranged with respect to a single plate 32. In particular, each of the penetrators 50 is pivotally coupled to the 32 by respective pivot blocks 88. Individual pockets 86 in the protector 70 may define a range of motion of the penetrators 50, e.g., between the oblique arrangement with respect to the plate 32 in the undeployed arrangement (FIG. 7A) to the approximately orthogonal arrangement with respect to the plate 32 in the deployed arrangement (FIG. 7B). Alternatively or additionally, the pivot blocks 88 may include a disc positioned between the plate 32 and the base of the penetrator 50. A resilient "hair" or sliver of the disc can bias the penetrator 50 toward the undeployed arrangement until a rod 82 erects the penetrator 50. Inflating the bladder 42 drives the rods 82 in the slots 84 and in turn causes the penetrators 50 to pivot in the pivot blocks 88 such that at least a portion of the penetrators 50 project outside of the pockets 86 as shown in FIG. 7B. Accordingly, the erector 80 facilitates using longer penetrators 50 that are concealed by the protector 70 in the undeployed arrangement of the device 10 and are exposed in the deployed arrangement of the device 10. Certain other embodiments according to the present disclosure may use a tape or another flexible tension member (not shown) to erect and/or retract the penetrators 50, possibly in response to the device 10 being deployed or due to a specific erecting action, e.g., provided by the winch 62. Accordingly, it is also envisioned that hinge springs positioned at the first and second joints 34 and 36 may provide additional energy for deploying the strap package 30 and/or pulling on the flexible member to erect the penetrators 50.

Figure 8A:
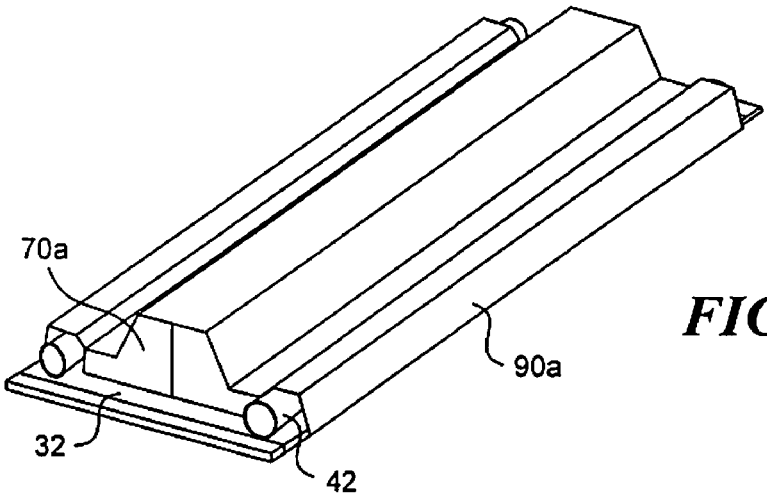
FIGS. 8A-8D are different views of a device according to an embodiment of the present disclosure showing a cover over foam spike protectors.
Figure 8B:
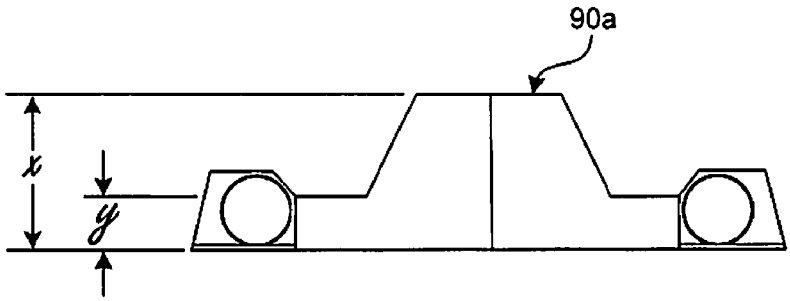
Figure 8C:
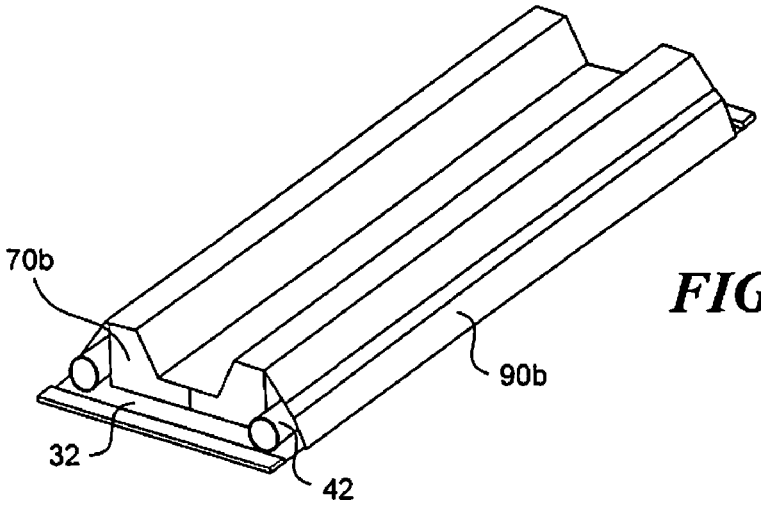
Figure 8D:
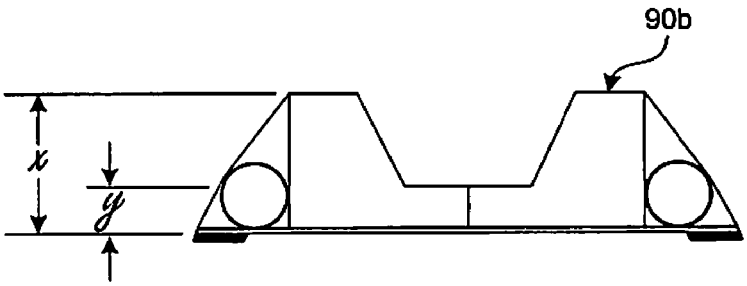

FIGS. 8A-8D show a cover over the foam protectors 70*a* and 70*b* shown in FIG. 5B. FIGS. 8A and 8C show perspective views of the interlocking protectors 70*a* and 70*b* including covers 90*a* and 90*b*, respectively. FIGS. 8B and 8D show cross-section views of the covers 90*a* and 90*b*, respectively. The covers 90 may be fixed, e.g., adhered, to the foam protectors 70 and/or wrap around and be fixed to the plates 32. The covers 90 also include channels that are sized to accommodate the inflated bladders 42. The covers 90 can include molded plastic, fiber tape or another material suitable for stiffening and/or sheathing the protectors 70.

The deployment of the inflatable strap package 30 will be carried out after the device 10 is positioned for use. A gas generator can be used as the pressure source 44 for deploying of the strap package 30. The gas generator may be activated by an operator from a remote location through use of an actuation device such as a radio signal generator or other remote switching device. Alternatively a proximity detector can be used to actuate the device 10 and deploy the strap package 30 when a target vehicle comes into the range of the proximity detector. By rapidly filling the tubular straps with gas generated in the gas generator, or with gas released from a storage device, the inflatable bladders 42 and the attendant strap package 30 will deploy from the armed position as shown in FIG. 2B to the deployed position as shown in FIG. 2C.

In operation the device 10 will be placed at a location where a target vehicle is expected to pass over the device 10. The device 10 can be placed at the side or on a road, at a check point or choke point inside or between barriers, or anywhere that is in the expected path of a target vehicle. Certain embodiments according to the present disclosure include incorporating the device 10 into typical environmental features to camouflage the presence of the device 10. Once positioned in the expected path of a target vehicle, the device 10 is prepared for deployment by safely arming the device remotely by a proximity sensor, a radio frequency remote activator, a hard-wired controller, etc. Alternatively, the device 10 may be armed by a person opening the housing 20 or having a user trip a switch on the device 10. As a target vehicle approaches the device 10, the strap package 30 will be deployed, e.g., by an operator sending a signal to the device to activate the gas generator to inflate the tubular bladders 42. The target vehicle will drive over the strap package 30 and the penetrators 50 will engage a ground traction device, e.g., tire, on the target vehicle. Thereafter, the tubular bladders 42 may be deflated and the strap package 30 retracted by the winch 62. Accordingly, retracting the device 10 may allow pursuing vehicles, e.g., security personnel vehicles, to not drive over the strap package 30 and the penetrators 50.

The operation of one embodiment according to the present disclosure will now be described. An operator will open the device 10 and retrieve the firing controller (either FOB or auxiliary handheld control box 540), turn ON the system switch 510 and turn the knob 412*a* to open the supply valve 412 to pressurize the accumulator tank 420. This will provide a regulated supply of pressurized gas, e.g., nitrogen at approximately 600 psi, to the accumulator tank 420 from the supply tank 410. The operator will close the supply valve 412 after the accumulator tank 420 reaches equilibrium at the pressure regulated by the pressure regulator 414. This whole process will only take approximately 5 seconds. Now the inflator device 40 is armed. Once deployment is to be initiated, the deployment valve 432 will inflate the bladders 42 thereby causing the strap package 30 to deploy. The deployment valve 432 may remain open for approximately two seconds before closing. The deployed strap package 30 is now deployed and available to engage a target vehicle that runs over the strap package 30 or to be retracted to avoid engaging a vehicle other than a target vehicle. Operation of the retractor device 60 can be prevented for approximately five seconds after deployment commences, thereby preventing premature retraction.

In the case of retracting the strap package 30, e.g., to avoid engaging a vehicle other than the target vehicle, the vent valve 440 is opened and the retraction device 600 is turned ON, e.g., for approximately three seconds, to retract the strap package 30 back into the housing 20. At this point, the both the inflator device 400 and the retractor device 600 may be disabled and cannot be re-activated without turning the power switch OFF and then back ON. Accordingly, the device 10 may include an automatic safety feature after being deployed and retracted.

There may be residual pressure, e.g., approximately 300 psi, in the accumulator tank 420 after the strap package 30 is deployed. The operator may turn the knob 422*a* to open the drain valve 422 to drain off this residual pressure to atmosphere. Certain embodiments according to the present disclosure may be stored with the drain valve 422 in its OPEN setting as a safety feature against compressed gas flowing to the bladders 42 in the undeployed arrangement of the device 10 (FIG. 2A). Additionally, placing the supply valve 412 in its CLOSED setting in the undeployed arrangement of the device 10 provides a precaution to avoid loss of pressure from the high pressure reservoir 410. Certain embodiments according to the present disclosure may include a self-sealing, pressurized bottle as the high pressure reservoir 410. Such a bottle can be disconnected, e.g., unscrewed, from the device 10 as a further precaution to avoid loss of pressure from the high pressure reservoir 410. When storing the device 10, the operator may verify the implementation of the precaution(s) to avoid loss of pressure from the high pressure reservoir 410 and turn OFF the system switch 510.

Figure 9A:
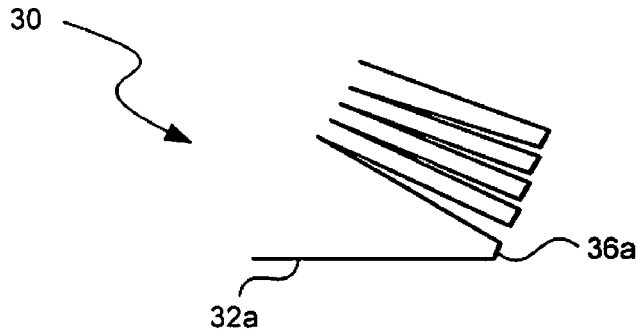
FIGS. 9A-9C schematically show several stages characterizing the deployment dynamics of a device according to an embodiment of the present disclosure.
Figure 9B:
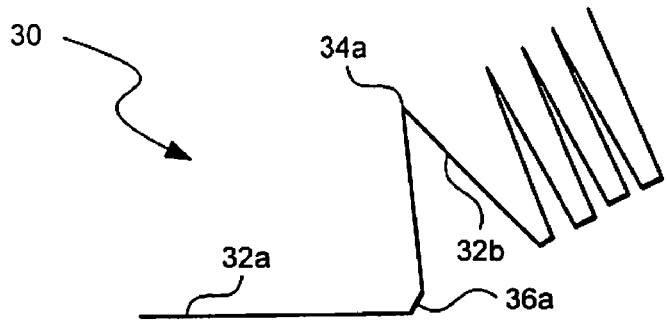
Figure 9C:
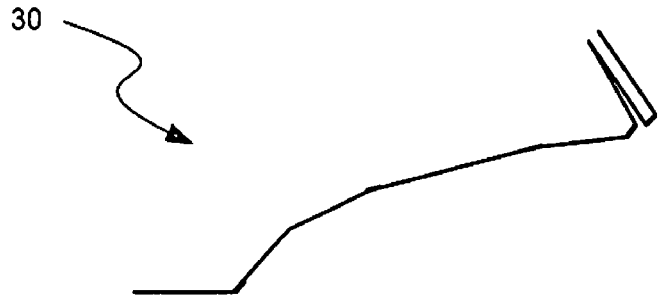

The operation of one embodiment of the strap package 30 according to the present disclosure will now be described with reference to FIGS. 9A-9C. There are several stages that may characterize the deployment dynamics. FIG. 9A shows a first stage including initial stack rotation. The entire backing plate stack rotates about the second joint 36*a* during the first stage. The joint 36*a* keeps the rotating structure aligned and the stack balanced so that there is no 'out of plane' or torsional rotation. FIG. 9B shows a second stage that includes stack rotation and initial launch. The entire stack continues to rotate past an approximately 45 degree angle about the second joint 36*a* and begins exhibit a 'linear' trajectory along the direction of unfurlment (Z-axis). The stack now begins to 'lift' from the plate 32*b*. As with the first stage, the first and second joints 34 and 36 keep the rotating structure aligned and the stack balanced so as to minimize 'out of plane' displacements. FIG. 9B also shows "unkinking" the tubular bladders 42 at the first joint 34*a* such that the next "chamber" or segment of the tubular bladders 42 begins to inflate. FIG. 9C shows a third stage that includes launching the stack. The stack may be a few degrees from vertical and exhibits a forward velocity and kinetic energy. After a successful launch, the first and second joints 34 and 36 ensure that the degrees of freedom during deployment continue to minimize or eliminate 'out of plane' or torsional rotations. Subsequent stages of the deployment dynamics include when the stack is about half its original size and there is enough kinetic energy in the system to extend the remainder of the plates to full deployment. Again, the first and second joints 34 and 36 continue to minimize or eliminate 'out of plane' or torsional rotations by the plates that have 'touched down' on the ground. In a final stage of the deployment dynamics, all of the plates 32 are fully extended. Following deployment, the strap package 30 can be retracted by deflating the bladders 42 and winding the cable 64 with the winch 62. The bladders 42 may be deflated by manual or automatically timed operation of a valve, electromagnetic solenoid, or any other device suitable for releasing gas pressure in the bladders 42.

An advantage of the device 10 is that it avoids putting security personnel in danger since the device 10 can be placed in position and then deployed and/or retracted remotely. Thus, the person placing the device 10 can stand off from the device 10 at a safe distance from the expected path of a target vehicle, and the strap package 30 of the device 10 can be deployed when a target vehicle approaches the location of the device 10. The remotely deployed device 10 may therefore be safer than using the convention spike strips that must be tossed in front of an approaching target vehicle.

Another advantage of the device 10 is that the strap package 30 is reloadable. In particular, the plates 32, penetrators 50, and pressure source 44 may be reloaded after deploying the device 10. Moreover, only those portions of the device 10 that are used need to be replaced. These portions may include, for example, the crushed sections of foam 70, the removed penetrators 50, and/or the exhausted gas generator 44.

Yet another advantage of the device 10 is the ability to slow, disable, immobilize and/or restrict the movement of a land vehicle with a device that is relatively insensitive to precise placement underneath a target vehicle. Moreover, the device 10 may be automatically and/or remotely armed and triggered for deploying the device 10 with minimal user intervention.

The above detailed description of embodiments is not intended to be exhaustive or to limit the invention to the precise form disclosed above. Also, well-known structures and functions have not been shown or described in detail to avoid unnecessarily obscuring the description of the embodiments of the present disclosure. While specific embodiments of, and examples for, the invention are described above for illustrative purposes, various equivalent modifications are possible within the scope of the invention, as those skilled in the relevant art will recognize. As an example, certain embodiments of devices 10 according to the present disclosure may include a pressure generator disposed in a device control housing with other operating elements, such as, but not limited to, a pressure delivery manifold, control circuitry to arm and deploy the strap or straps, a proximity detector, a signal receiving and sending circuit and any other hardware, software or firmware necessary or helpful in the operation of the device 10. As another example, the device 10 may be housed in a clamshell-type briefcase or ammunition box type housing and include a pressure manifold and a pressure-generating device, such as compressed gas or a gas generator connected to the manifold. In other embodiments more than one manifold and more than one pressure generating device, or any combination thereof, may be included in the device 10.

Unless the context clearly requires otherwise, throughout the description and the claims, the words "comprise", "comprising", and the like are to be construed in an inclusive sense, as opposed to an exclusive or exhaustive sense; that is to say, in the sense of including, but not limited to. Additionally, the words "herein", "above", "below", and words of similar connotation, when used in the present disclosure, shall refer to the present disclosure as a whole and not to any particular portions of the present disclosure. Where the context permits, words in the above Detailed Description using the singular or plural number may also include the plural or singular number respectively. The word "or", in reference to a list of two or more items, covers all of the following interpretations of the word: any of the items in the list, all of the items in the list, and any combination of the items in the list.

While certain aspects of the invention are presented below in certain claim forms, the inventors contemplate the various aspects of the invention in any number of claim forms. Accordingly, the inventors reserve the right to add additional claims after filing the application to pursue such additional claim forms for other aspects of the invention.

The invention claimed is:

1. An apparatus for disabling a ground engaging traction device of a land vehicle, comprising:

a penetrator configured to breach the traction device;

an articulated strap configured to move between a retracted arrangement and an extended arrangement, the articulated strap includes a plurality of plates coupled to the penetrator; and a plurality of joints, wherein an individual joint couples individual adjacent plates;

an inflatable bladder configured to deploy the articulated strap to the extended arrangement;

an inflator including a charge of pressurized fluid configured to inflate the inflatable bladder a plurality of occurrences; and a retractor configured to retract the articulated strap to the retracted arrangement after individual occurrences of inflating the bladder.

2. The apparatus of claim 1 wherein the penetrator comprises a hollow spike extending from a sharp tip to a base coupled to an individual plate.

3. The apparatus of claim 1 wherein the retracted arrangement of the articulated strap comprises overlying the plates in a stacked arrangement, and the extended arrangement of the articulated strap comprises positioning the plates in an end-to-end arrangement.

4. The apparatus of claim 1 wherein the plurality of joints comprises first and second joints, individual first joints include a single pivot axis coupling individual adjacent plates, individual second joints include separate pivot axes spaced by a link coupling individual adjacent plates, and wherein the plurality of joints includes alternating first and second joints.

5. The apparatus of claim 1 wherein the inflator comprises a valve configured to release pressurized fluid from the reservoir to inflate the inflatable bladder each of the plurality of occurrences.

6. The apparatus of claim 1 wherein the inflator comprises:

a reservoir configured to store the charge of pressurized fluid, an accumulator coupled to the reservoir and configured to hold pressurized fluid for individual occurrences of inflating the bladder;

a first valve configured to control pressurized fluid flow between the reservoir and the accumulator; and a second valve configured to control pressurized fluid flow between the accumulator and the inflatable bladder.

7. The apparatus of claim 6 wherein the inflator comprises a pressure regulator in fluid communication between the reservoir and the accumulator.

8. The apparatus of claim 6 wherein the inflator comprises a third valve configured to drawn pressurized fluid from the accumulator.

9. The apparatus of claim 1, wherein the retractor comprises a cable coupled to the plates and a winch coupled to the cable, wherein the winch is coupled to a first end of the plurality of plates, the cable is fixed to a second end of the plurality of plates, and the cable is slidingly coupled to intermediate plates between the first and second ends of the plurality of plates.

10. The apparatus of claim 1, further comprising a valve configured to vent pressurized fluid from the inflatable bladder.

11. The apparatus of claim 1 further comprising:

foam coupled to individual plates and configured to protect the penetrator; and a cover overlying the foam.

* * * * *